United States Patent [19]

Dassance et al.

[11] Patent Number: 5,074,033

[45] Date of Patent: Dec. 24, 1991

[54] APPLICATOR DIE

[75] Inventors: Donald A. Dassance, Cadillac; Richard E. Feldborg, Grosse Point, both of Mich.

[73] Assignee: ACU-Crimp, Inc., Mesick, Mich.

[21] Appl. No.: 568,222

[22] Filed: Aug. 16, 1990

Related U.S. Application Data

[63] Continuation-in-part of Ser. No. 418,501, Oct. 10, 1989, Pat. No. 4,959,988.

[51] Int. Cl.[5] ..... H01R 43/04

[52] U.S. Cl. ..... 29/753; 29/566.2

[58] Field of Search ..... 29/564.6, 748, 753, 29/863, 566.2

[56] References Cited

U.S. PATENT DOCUMENTS

| | | | |
|---|---|---|---|
| 3,004,581 | 10/1961 | Krol et al. | 29/753 |
| 3,343,398 | 9/1867 | Kerns | 72/413 |
| 3,455,006 | 7/1969 | Reem et al. | 29/753 |
| 3,969,806 | 7/1967 | McGaughey | 29/753 |
| 4,114,253 | 9/1978 | Loomis et al. | 29/753 |
| 4,306,443 | 12/1981 | Matsutani | 72/434 |
| 4,307,504 | 12/1981 | Davis et al. | 29/566.3 |
| 4,398,573 | 8/1983 | Kreid | 140/105 |
| 4,896,419 | 1/1990 | Jurgenhake et al. | 29/748 |

OTHER PUBLICATIONS

Diamond Die and Mold Company Crimping Apparatus (3 shts) Drawings.
Artos Crimping Apparatus Drawing (1 sheet).
Amp, Inc. Crimping Apparatus Drawing (1 sheet).
Toyojamco Crimping Apparatus Drawing (2 sheets).
Packard Crimping Apparatus Drawing (1 sheet).

*Primary Examiner*—Lowell A. Larson
*Attorney, Agent, or Firm*—Krass & Young

[57] ABSTRACT

An applicator die for use with a crimping machine of the type in which a supply of terminals are fed in the form of a terminal strip comprising a carrier band and a plurality of terminals respectively secured at one end thereof to successive points along the band, individual leads are fed to the machine and the machine functions to crimplingly apply a terminal to an end of each lead and sever the terminal from the carrier band. The applicator die includes, a hanger structure extending downwardly along a side edge of the horizontal guide plates to a location below the guide plates, and a feed finger pivotally mounted on the lower end of the hanger structure underneath the guide plates and including a pointed end extending upwardly through a slot in the lower guide plate for engagement with drive holes in the terminal strip. The die also includes a gathering mechanism in the form of a the slide to gather up the leads and ensure that they are properly oriented relative to the feed path of the terminal strip and relative to the crimping and severing dies.

26 Claims, 8 Drawing Sheets

APPLICATOR DIE

RELATED APPLICATION

This application is a continuation-in-part of U.S. patent application Ser. No. 418,501 filed on Oct. 10, 1989, now U.S. Pat. No. 4,959,988 granted Oct. 2, 1990.

BACKGROUND OF THE INVENTION

This invention relates to applicator dies and more particularly to an applicator die for use with a press to form a crimping machine for crimpingly securing terminals to the ends of leads.

Modern industry requires vast quantities of electrical leads with terminals crimpingly secured to the ends of the lead and many forms of applicator dies have been devised to perform the required crimping operation. Typically, the terminals to be crimped to the ends of the lead are provided in the form of a terminal strip comprising a plurality of serially arranged, interconnected terminals. The leads are fed individually to the die, and the die functions to crimpingly apply a terminal to the end of each lead and sever the terminal from the terminal strip in a manner to produce a continuous series of leads each having a terminal crimpingly secured to an end of the lead. Whereas many applicator dies have been proposed and are currently available, and whereas the various dies are generally satisfactory with respect to performing the required crimping operation, each applicator die tends to be dedicated or limited to use in one or possibly a select few of the available crimping machines and there is no one applicator die available that is suitable for use in all of the crimping machines in current usage.

Further, the available dies generally lack any means for ensuring that the leads are maintained in a positive predetermined orientation relative to the terminal feed path during the crimping operation so as to ensure a proper crimp and such mechanisms as are currently available to ensure such positive orientation are unduly complicated and expensive.

SUMMARY OF THE INVENTION

This invention is directed to the provision of an improved applicator die which is usable in virtually all currently utilized crimping machines.

More specifically, this invention is directed to the provision of an improved applicator die which has universal application to present day crimping machines irrespective of the manner in which the leads are fed to the crimping machine and irrespective of the length of the stroke of the crimping machine.

This invention is further directed to the provision of an improved applicator die including simple and effective gathering means to ensure that the leads are maintained in a positive predetermined orientation relative to the feed path during the crimping operation.

This invention is further directed to the provision of an applicator die having an improved braking mechanism to provide a smooth uniform braking action for the terminal strip as it is fed to the die means.

The applicator die according to one feature of the invention includes a housing defining a generally vertical slideway; means defining a generally horizontal feed path for the terminal strip; a slide mounted for reciprocal generally vertical sliding movement in the slideway; die means operative in response to sliding movement of the slide in the slideway to crimp a terminal to a lead and sever the terminal from the terminal strip; a support structure supported on the housing at a location above the feed path and extending downwardly past the feed path to a location beneath the feed path; a feed member mounted on the support structure beneath the feed path and movable when actuated to incrementally advance the terminal strip along the feed path toward the die means; and actuator means operative in response to sliding movement of the slide in the slideway to actuate the feed member. This arrangement provides a simple feeder structure for the terminal strip which allows total freedom with respect to the manner in which the leads are fed to the crimping machine.

According to a further feature of the invention, the actuator means comprise cam means. This arrangement provides a direct positive action for the feed member.

According to a further feature of the invention, the feed path defining means comprises a guide plate defining the feed path thereabove and the feed member comprises a feed finger positioned beneath the guide plate. This specific arrangement of the guide plate and feed finger clears the area above the guide plate to allow total flexibility with respect to the manner in which the leads are fed to the machine.

According to a further feature of the invention, the guide plate includes a slot extending in the direction of the feed path and the feed finger includes a pointed drive end adapted to be positioned in the slot for engagement with the underside of the terminal strip. This specific arrangement facilitates the ready engagement of the feed finger with the terminal strip to facilitate the incremental feeding of the terminal strip to the dies.

According to a further feature of the invention, the cam means providing the actuator means for the feed member includes a cam plate positioned above the feed path, and position the lead in a predetermined orientation relative to the feed path and relative to the die means if the lead is not already in that predetermined orientation. This arrangement ensures that the lead will be positively oriented relative to the feed path and relative to the die means to ensure a proper crimp.

According to a further feature of the invention, the gathering means is carried by the slide. This arrangement simplifies the construction of the applicator die and ensures a positive action of the gathering means.

According to a further feature of the invention, the gathering means comprises a pair of fingers carried by the slide and mounted for relative pivotal movement in scissors fashion. This arrangement provides a simple and effective mechanism to ensure that the leads are positively oriented relative to the feed path.

According to a further feature of the invention, the fingers are pivotally mounted intermediate their upper and lower ends about a common axis on the slide; the upper ends of the fingers coact with cam means carried by the housing proximate the slideway to move the finger upper ends toward and away from each other in response to movement of the slide; and the lower ends of the fingers are moved into gathering relation to opposite sides of the lead as the slide moves downwardly in the slideway. This arrangement a hanger structure is secured to the cam plate and extends to a location beneath the feed path, and the feed finger is pivotally mounted on the hanger structure. This arrangement provides a convenient means of positioning the feeder finger beneath the feed path.

According to a further feature of the invention, the cam means includes a cam member including a cam surface and a cam follower movable relative to the cam surface in response to sliding movement of the slide in the slideway and the cam surface includes a first action portion coacting with the cam follower to actuate and move the feed finger upon upward movement of the slide in the slideway and a second dwell portion adjoining the action portion coacting with the cam follower to allow movement of the cam follower relative to the cam member upon further upward movement of the slide in the slideway without moving the feed finger. This specific cam arrangement allows the invention applicator die to be utilized with crimping machines having various strokes with the stroke variations being accommodated by the dwell movement of the cam follower with respect to the dwell portion of the cam surface.

According to a further feature of the invention, the applicator die includes gathering means driven by the slide and operative in response to downward movement of the slide to gather up a lead positioned proximate the die means provides a simple, effective and positive means of positively orienting the leads utilizing available slideway structure.

According to a further feature of the invention, the applicator die includes braking means for the terminal strip in the form of a brake assembly positioned beneath the feed path and including a brake element spring biased upwardly to bring a braking surface on the brake element into frictional engagement with the undersurface of the terminal strip. This arrangement provides a simple and positive means of ensuring smooth, positive braking action to the terminal strip as it is fed along the feed path to the die means.

DETAILED DESCRIPTION OF THE PREFERRED EMBODIMENT

Figure 1:
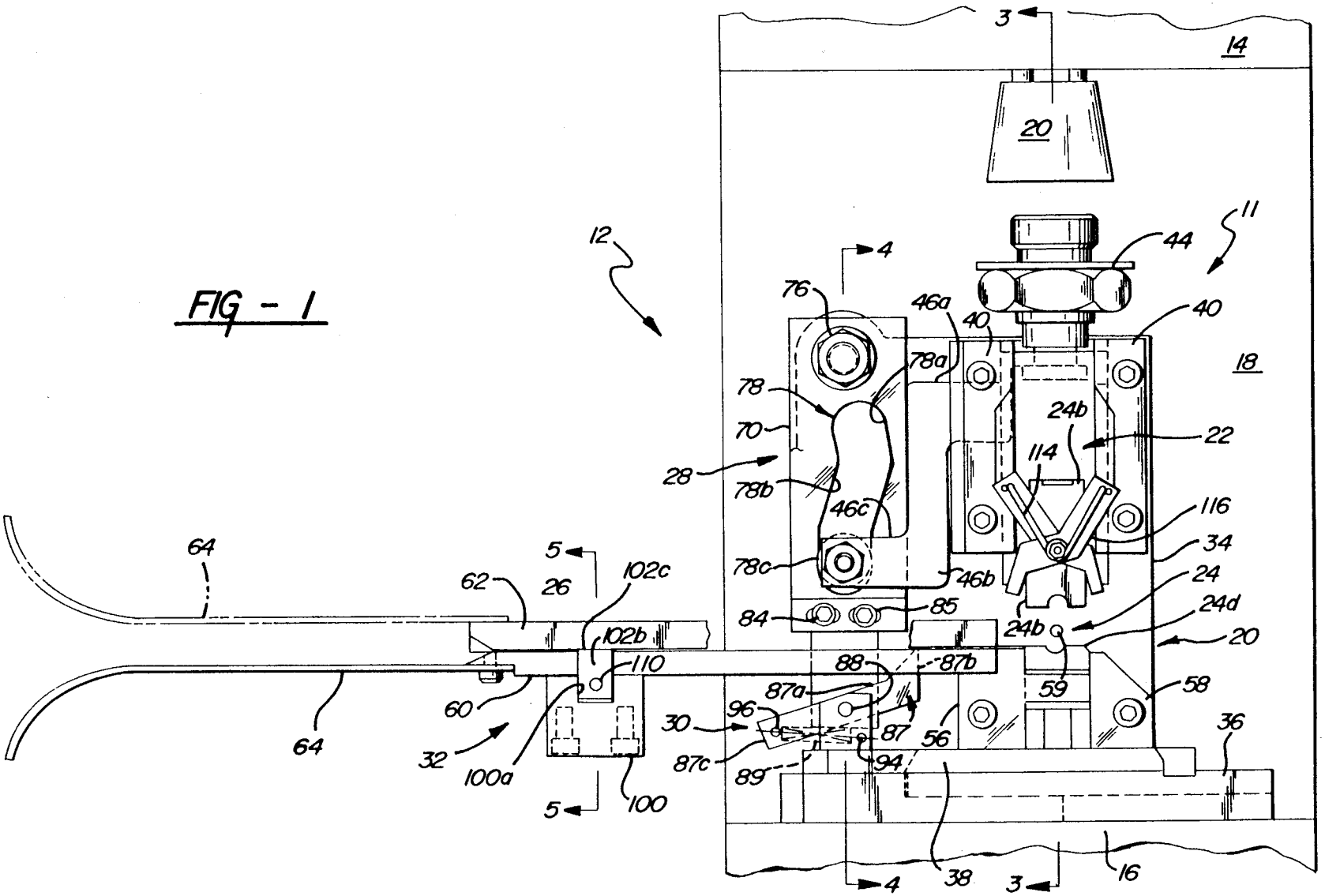
FIG. 1 is a front elevational view of a crimping machine employing the applicator die of the invention.

The invention applicator die is intended for use with a terminal strip 10 comprising a plurality of serially arranged, interconnected terminals. Strip 10 may for example be of the type seen in FIG. 7 including a carrier band 10*a* and a plurality of terminals 10*b* respectfully secured at one end thereof to successive points along the carrier band 10*a*. Carrier band 10*a* also includes a drive hole 10*c* positioned opposite each terminal 10*b* for coaction with a feed finger of the applicator die.

The invention applicator die 11 is seen in the drawings in association with a press 12 of the type including a head 14, a bed 16, a back structure 18 interconnecting the head and the bed, and a ram 20, shown schematically, mounted in known manner on the head 14 for powered reciprocal movement to provide the power for a die positioned on the bed of the press.

Applicator die 11 includes a housing or frame assembly 20, a slide 22, die means 24, a feed path assembly 26, a support structure 28, a feed finger assembly 30, and a brake assembly 32.

Housing or frame assembly 20 includes a housing member 34, a sub-plate 36, and an adaptor plate 38. Adaptor plate 38 is suitably secured to sub-plate 36 and housing 34 is suitably secured in upstanding fashion to adaptor plate 38.

Housing member 34 includes an upstanding main body portion 34*a* and a pair of spaced vertical portions 34*b* and 34*c*, coacting with gibs 40 to define a rectangular vertical slideway 42, and a base portion 34*d*. Slide 22 is sized to fit in slideway 42 so as to be freely reciprocal in slideway 42 in response to upward and downward movement of ram 20 with the applicator die positioned on the bed 16 of the press and with the slide 22 positioned in underlying relation to the ram. If required or desired, an adaptor member 44 may be secured to the upper end of the slide to facilitate engagement of the slide by the ram. An arm 46 is suitably secured to slide 22 and includes an upper portion 46*a* passing through a slot 34*d* defined in housing member portion 34*b*, a vertically extending central portion 46*b*, and a lower portion 46*c* carrying a cam follower or pin 50 secured to arm portion 46*c* by a bolt 52 and nut 54.

Die means 24 do not form a part of the present invention and are of known form and may include a crimping die 24*a* and a cutter punch 24*b* positioned in stacked fashion in a cutout or pocket 22*a* opening in the lower and forward faces of the slide 22 for respective coaction with a crimping die 24*c* and a cutter die 24*f* positioned on housing base portion 34*d* between holders 56 and 58 forming a part of the housing assembly. Crimping die 24*a* and cutter punch 24*b* may be secured to slide 22 within cutout 22*a* by a bolt 56 passing through aligned apertures 24*g* and 24*h* in cutter punch 24*b* and crimping die 24*a* for threaded engagement with a tapped blind bore 22*b* in slide 22 opening in cutout 22*a*. Bolt 56 includes a head 56*a* positioned in a counter-bore 24*i* opening in the front face of cutter punch 24*b*. Die means 24 function in known manner in response to downward stroking movement of slide 22 to crimp a terminal 10*b* to the exposed end 59*a* of a lead 59 and also to sever the terminal from the carrier band 10*a* of the terminal strip 10.

Feed path assembly 26 includes a lower guide plate 60, an upper guide plate 62, and a guide bracket 64. Guide plates 60 and 62 are secured in known manner to housing assembly 20 and coact to define a feed path for the terminal strip 10 extending in a generally horizontal manner from a location outboard of the die means 24 to the die means 24 so as to incrementally feed the terminal strip 10 to the dies for the appropriate crimping and cutting action by the dies.

Figure 5:
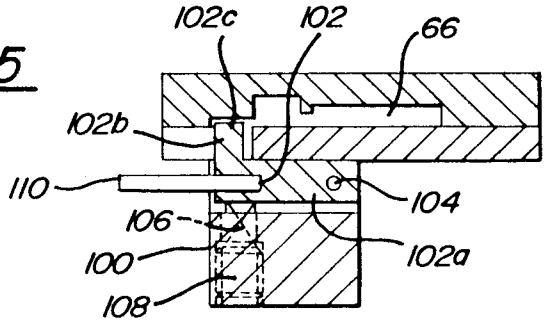
FIGS. 3, 4 and 5 are cross-sectional views taken on lines 3—3, 4—4 and 5—5 respectively of FIG. 1.
Figure 2:
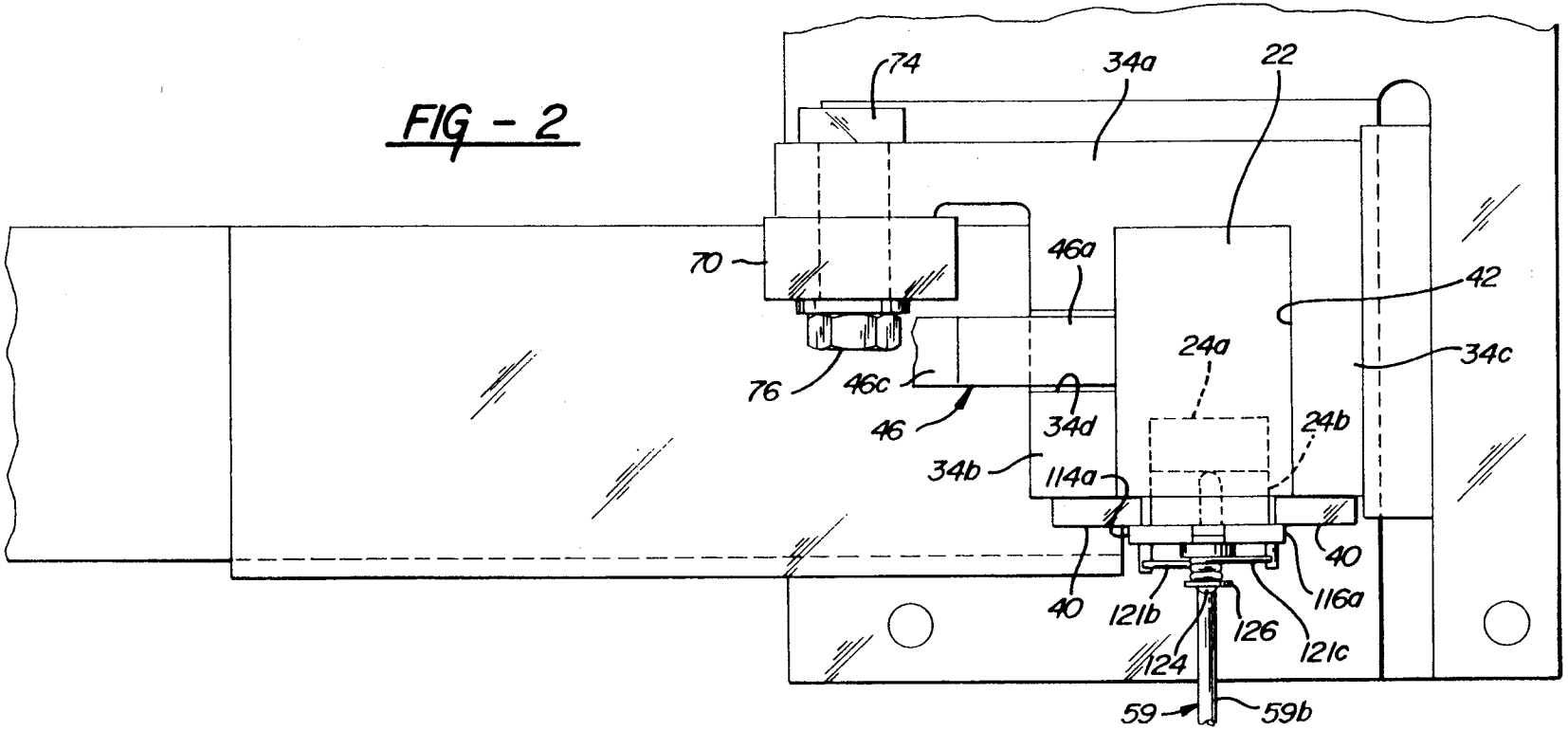
FIG. 2 is a top view of the applicator die of FIG. 1.
Figure 3:
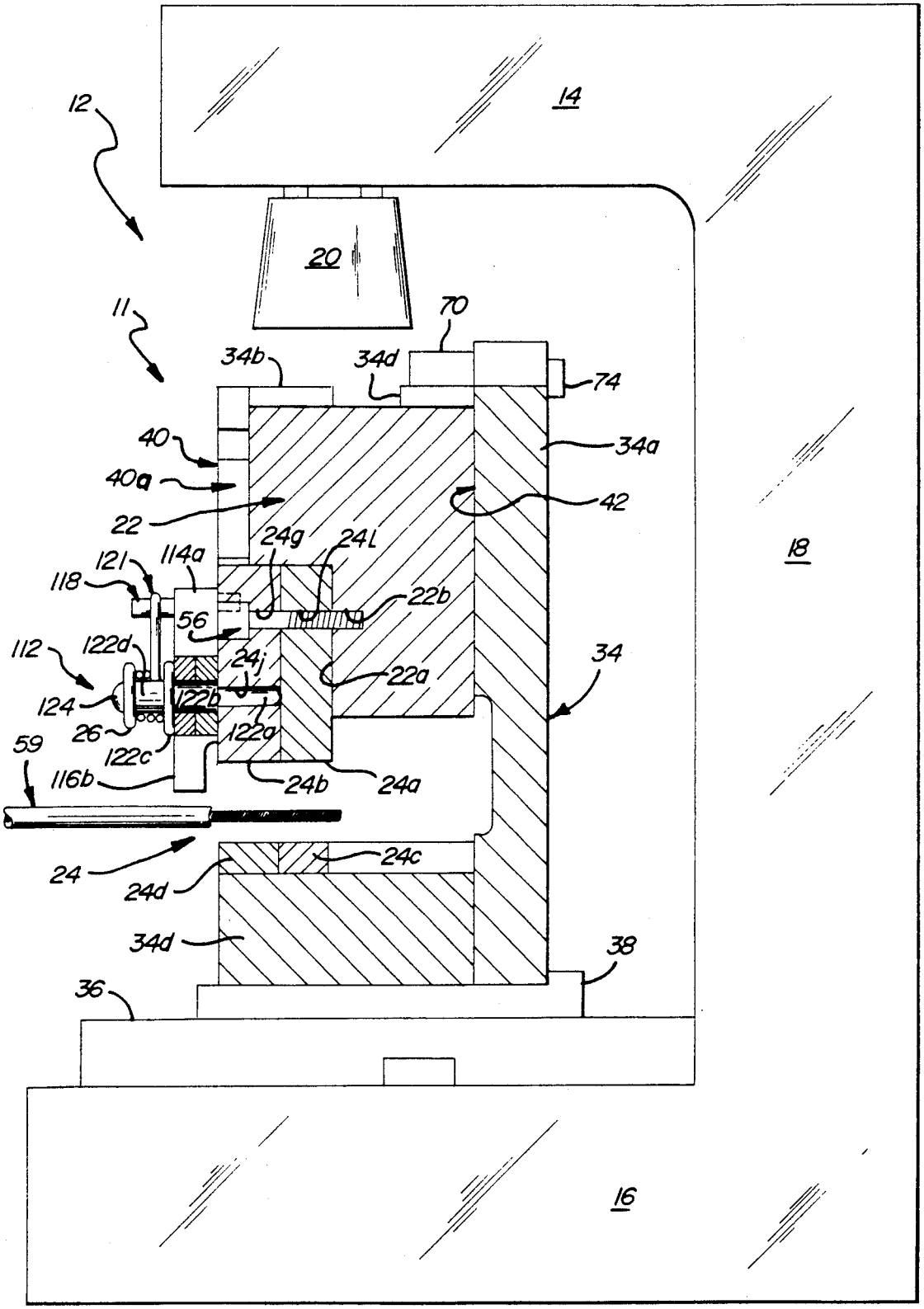
Figure 4:
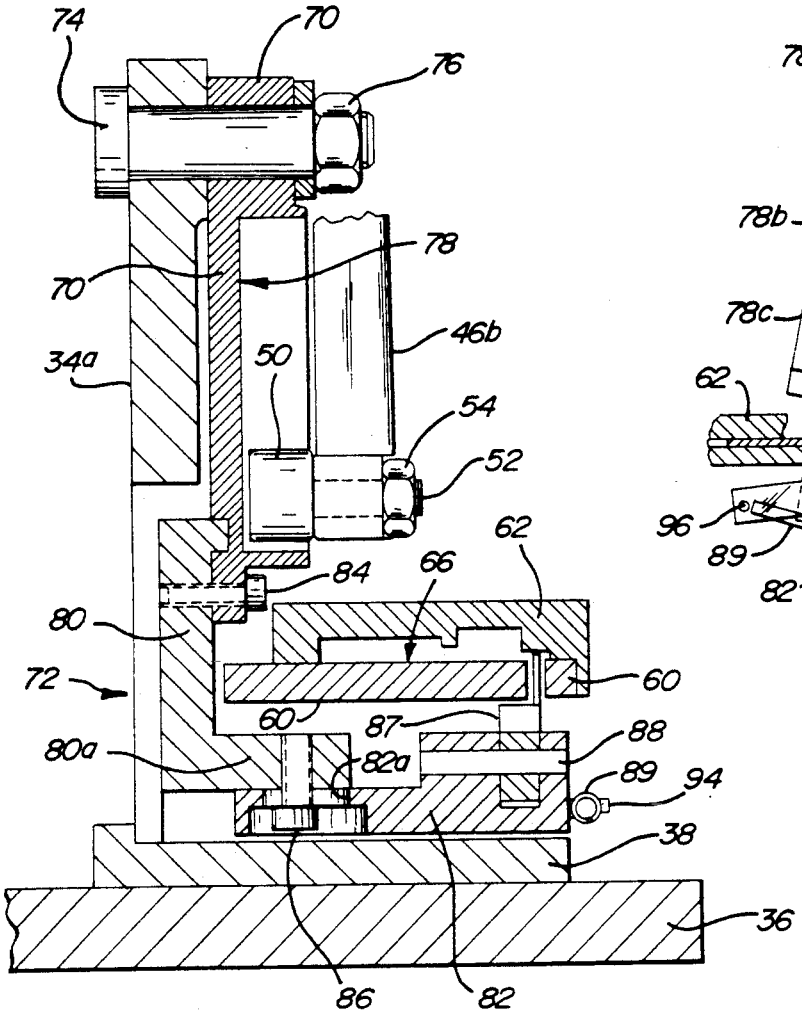
Figure 6:
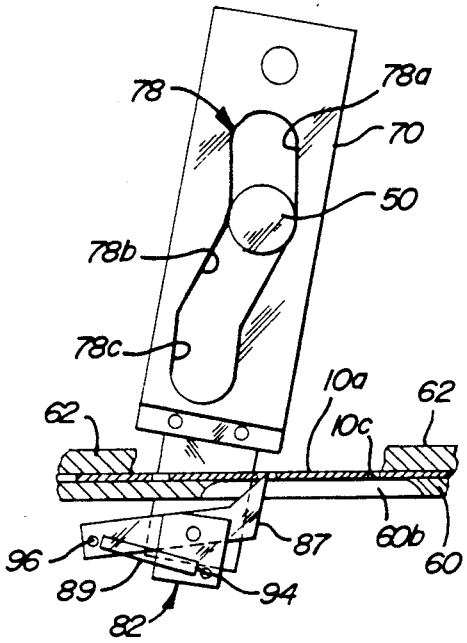
FIG. 6 is a fragmentary view of a portion of the applicator die seen in FIG. 1 showing a cam used in the die in a moved position.
Figure 9:
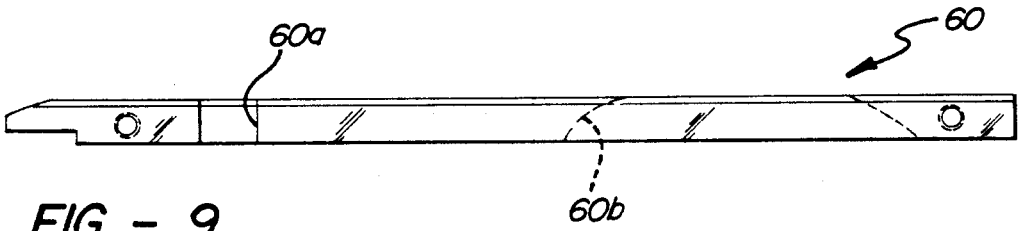
FIGS. 9 and 10 are detail views of a guide plate employed in the invention applicator die.
Figure 10:
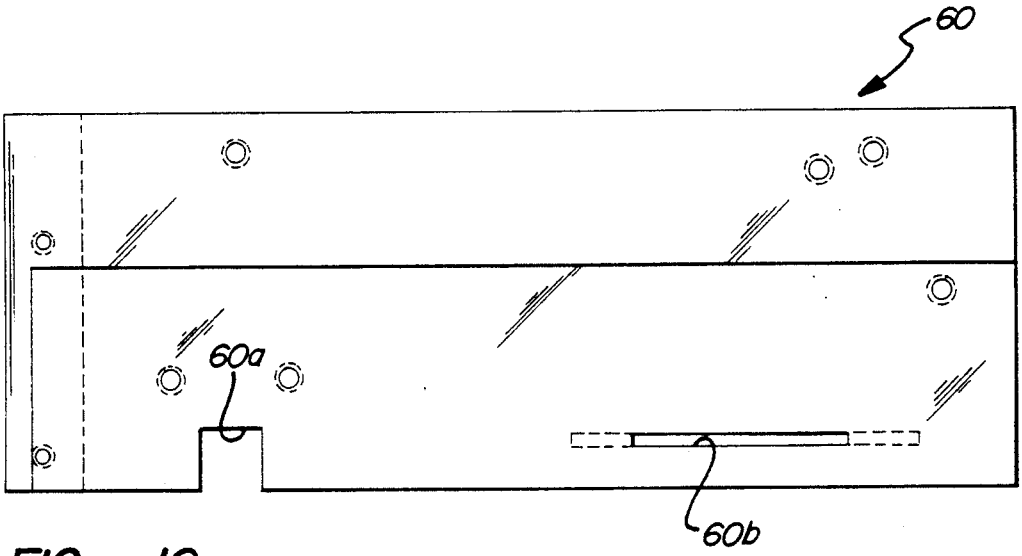
Figure 11:
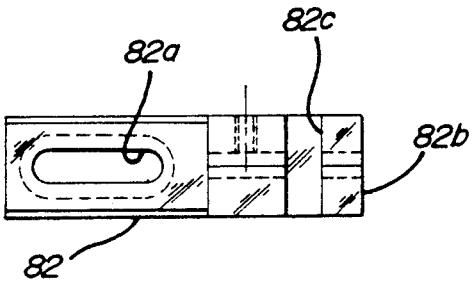
FIGS. 11 and 12 are detailed views of a feed finger holder employed in the invention applicator die.
Figure 12:
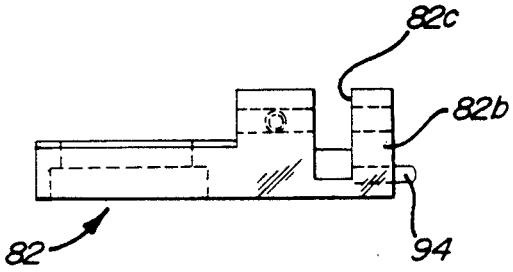
Figure 13:
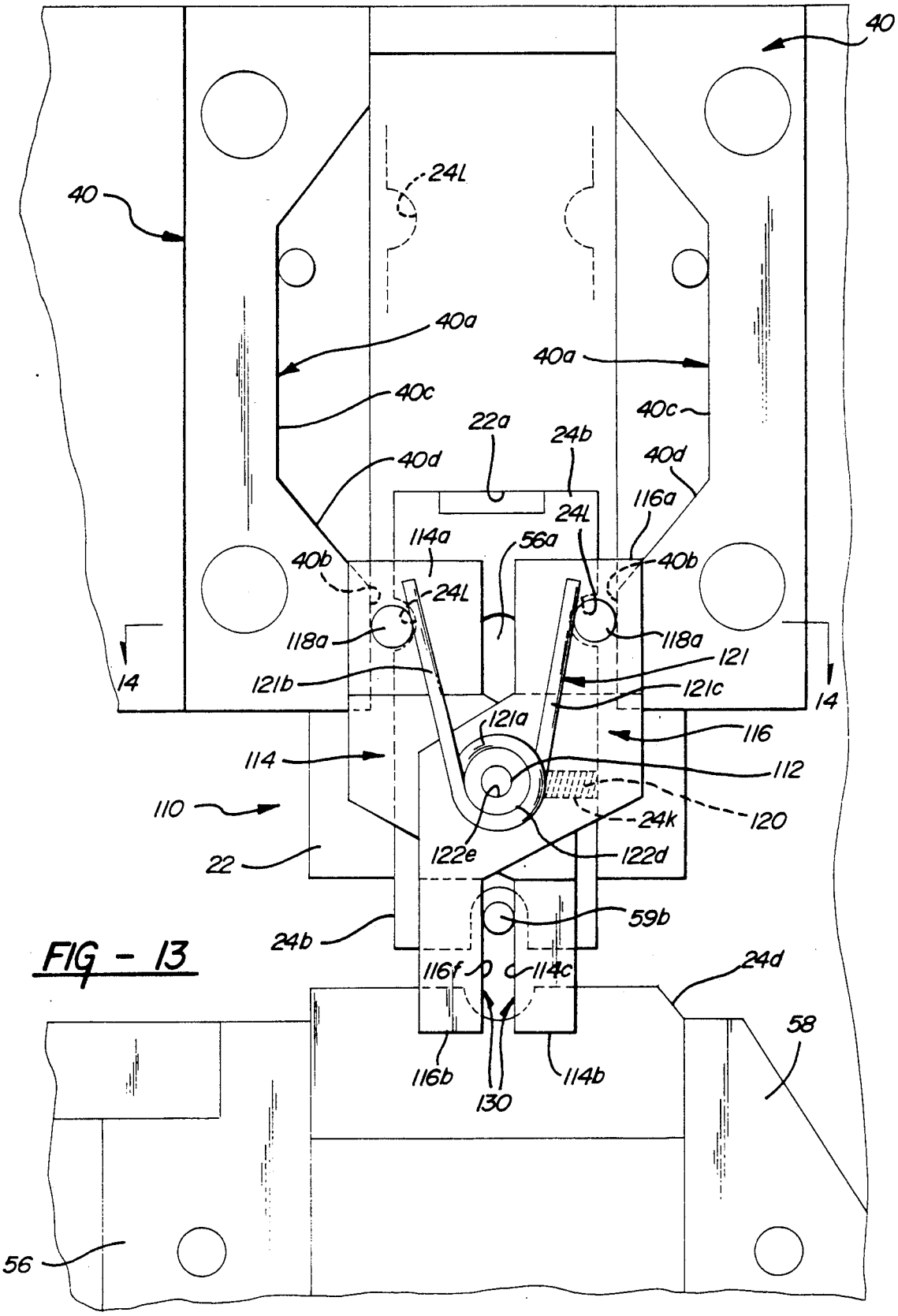
FIG. 13 is a view of a gathering mechanism employed in the invention applicator die.
Figure 14:
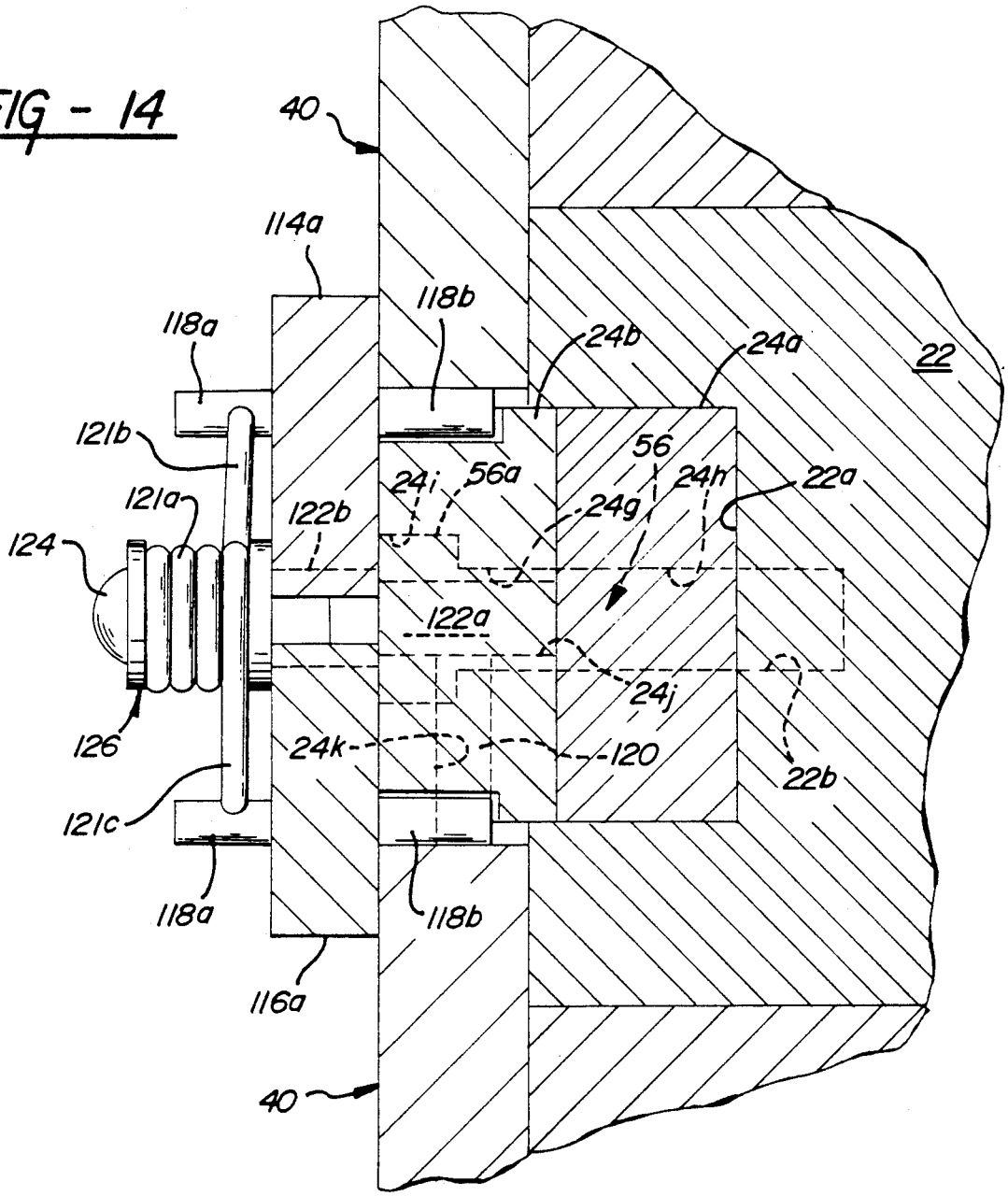
FIG. 14 is a cross-sectional view taken on line 14—14 of FIG. 13.
Figure 21:
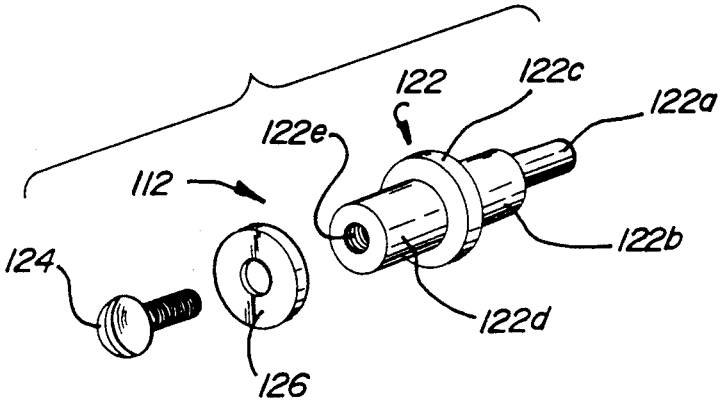
FIGS. 15-21 are detailed views of elements employed in the invention gathering mechanism.
Figure 15:
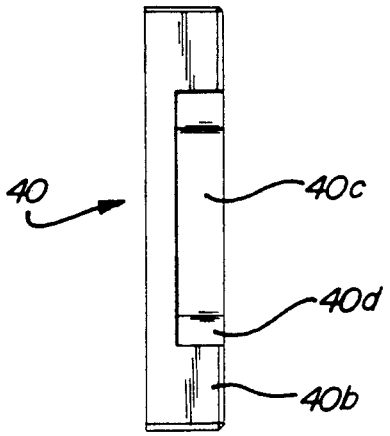
Figure 16:
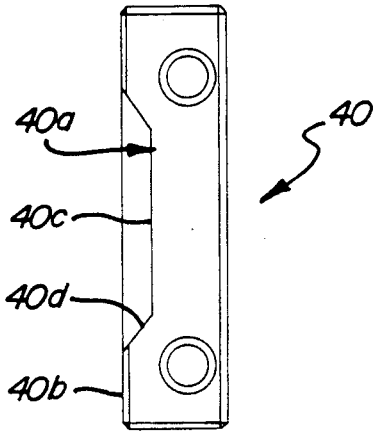
Figure 17:
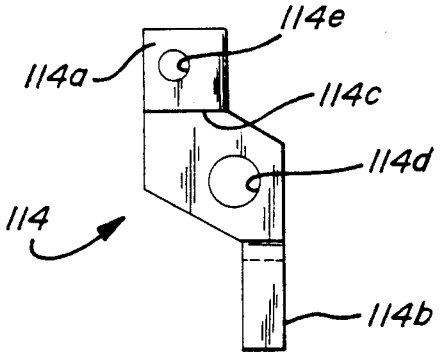
Figure 18:
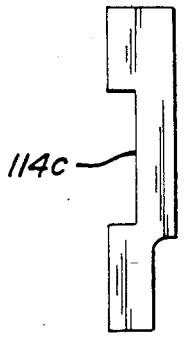
Figure 19:
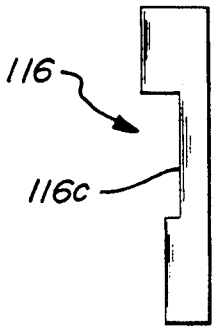
Figure 20:
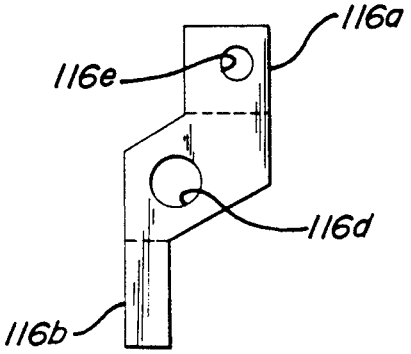

As best seen in FIGS. 4 and 5, lower guide plate 60 is of generally rectangular transverse cross section but upper guide plate 62 has a convoluted transverse cross sectional configuration to define a feed path cavity 66 between the plates configured to match and accommodate the cross-sectional configuration of terminal strip 10. Lower guide plate 60, as best seen in FIGS. 9 and 10, includes a cutout 60*a* proximate the output end of the plate and a longitudinally extending slot 60*b* proximate the inboard end of the plate. Guide bracket 64 may be secured to the outboard end of either lower plate 60 or upper plate 62 depending upon the location of the source of the terminal strip to be fed to the dies 24 via the feed path assembly 26.

Support structure 28 includes a ca plate 70 and a hanger structure 72. Cam plate 70 has a generally rectangular configuration and is pivotally secured proximate its upper end to main body housing portion 34*a* by a pivot bolt 74 coacting with a nut 76. A cam slot or groove 78 is provided in cam plate 70 sized to receive cam pin or follower 50. Cam slot 78 includes an upper dwell portion 78*a*, an intermediate action portion 78*b*, and a lower dwell portion 78*c*.

Hanger structure 72 includes a hanger 80 and a feed finger holder 82. Hanger 80 is secured at its upper end to the lower end of cam plate 70 as by screws 84 and extends downwardly along one side edge of guide plates 60 and 62 to a location below guide plate 60 whereafter it extends laterally inwardly via a portion 80*a* to a location underneath cam plate 60 and overlying adaptor plate 38 of the housing assembly. Screws 84 are received in elongated slots 85 in the lower end of cam plate 70 so as to allow longitudinal adjustment of hanger 80 relative to the cam plate.

Feed finger holder 82 is secured to the free end of hanger portion 80*a* as by screws 86 with a slot 82*a* in holder 82 allowing significant transverse adjustment of the holder relative to the hanger. Holder 8 further includes a mounting portion 82*b* defining a groove or slot 82*c*.

Feed finger assembly 30 includes a feed finger 87, a pivot pin 88, and a coil spring 89. Feed finger 87 is in the form of a lever and includes a main body portion 87*a* and a reduced thickness pointed front end drive portion 87*b* sized to be positioned in slot 60*b* of guide plate 60. Finger 87 is pivotally mounted intermediate its ends to holder 82 by pivot pin 88 and is maintained in a constantly upwardly biased disposition by coil spring 89 which extends between a pin 94 carried by holder 82 and a pin 96 carried on the remote or trailing end 87*c* of the feed finger.

Brake assembly 32 includes a brake holder 100 and a brake lever 102. Holder 100 is suitably secured to the underface of lower guide plate 60 outboard of feed finger assembly 30 and proximate the entry end of the feed path defined by the plates 60, 62 and defines an upwardly opening U-shaped groove or slot 100*a* extending transversely with respect to the terminal strip feed path. Brake lever 102 includes a horizontal leg portion 102*a* positioned in slot 100*a* and a vertical leg portion 102*b* positioned in the cutout 60*a* in lower guide plate 60. Lever 102 is pivotally mounted relative to holder 100 by a pin 104 carried by the holder so that the brake lever 102 may pivot about the axis defined by pin 104 to bring the upper face 102*c* of leg 102*b* into and out of engagement with the underface of the carrier band 10*a* of the terminal strip 10 being fed along the guide feed path.

Brake lever 102 is constantly urged into braking coaction with the carrier band of the terminal strip by a coil spring 106 positioned in a bore in the holder 100 with the biasing force of the spring 106 being adjustable by selective adjustment of set screw 108. A handle 110 secured to lever 102 allows the brake lever to be moved downwardly when desired against the resistance of spring 106 to allow feeding of a terminal strip along the feed path. Brake lever 102 is dimensioned and configured such that the upper face 102*c* of the vertical leg 102*b* assumes a precisely horizontal disposition as the lever contacts the underface of the carrier band of the terminal strip so as to maximize the frictional braking interaction as between the brake lever and the terminal strip. The upward pivotal movement of the brake lever 102 under the influence of spring 106 is limited by the engagement of the upper face of leg portion 102*a* with the adjacent underface 60*c* of lower guide plate 60 so as to prevent upward distortion or deformation of carrier band 10*a* by excessive braking force exerted by spring 106.

Figure 7:
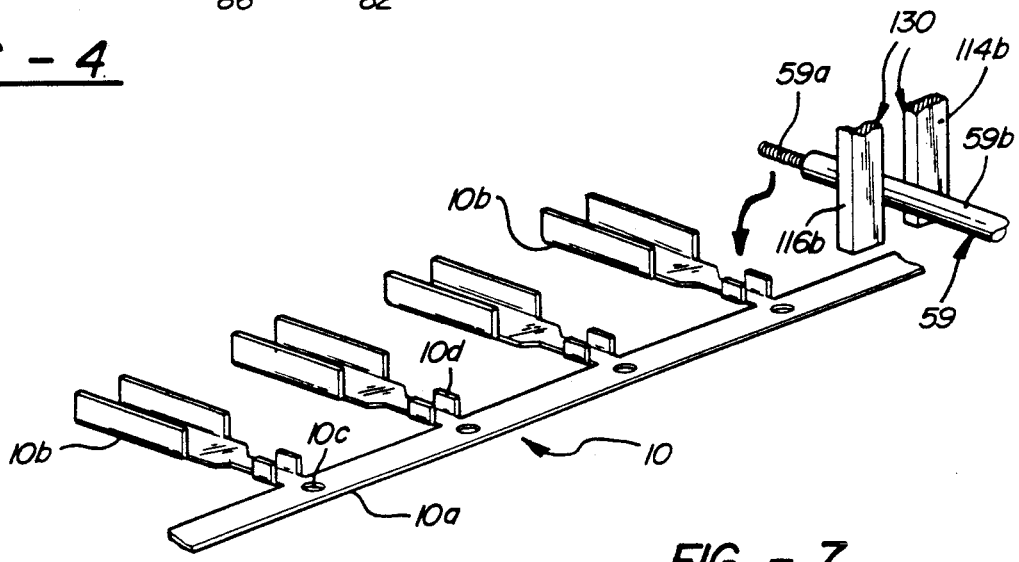
FIG. 7 is a fragmentary perspective view of a terminal strip shown in association with a lead.
Figure 8:
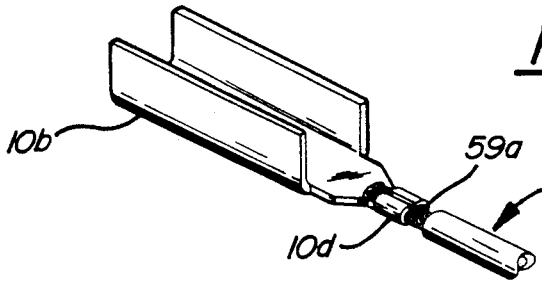
FIG. 8 is a fragmentary perspective view of a lead with a terminal crimpingly secured thereto.

As illustrated schematically in FIG. 7, applicator die 11 functions as the terminal strip 10 is fed into the die means 24 to selectively crimp portions 10*d* of each terminal 10*b* around the stripped back bare wire portion 59*a* of a lead 59, utilizing crimping dies 24*a* and 24*c*, whereafter the terminal is severed from the carrier band 10*a*, utilizing cutter punch 24*b* and cutter die 24*d*, to form the lead and terminal combination as seen in FIG. 8.

Terminal strip 10 is typically provided in reel form and is fed along bracket 64 into the space 66 defined between plates 60,62 and along the feed path defined between the plates to the dies 24. In operation, brake lever 102 exerts a constant frictional braking action on the underside of carrier band 10*a* as the terminal strip is fed incrementally by the feed finger 87 in response to reciprocating movement of slide 22.

Specifically, with pointed end 87*b* of feed finger 87 positioned in a drive hole 10*c* in terminal strip 10, as the slide 22 begins a downward stroke to initiate a crimping and cutting action by the dies 24, cam pin 50 coacts with cam slot 78 to drive feed finger 87 forwardly and advance a new terminal 10*b* into precise alignment with dies 24 so as to enable the terminal portions 10*d* to be crimped over the bare lead portion 59*a* of a lead 59 as the lead is simultaneously fed to the coacting dies.

The actual forward movement of the feed finger occurs as the cam pin 50 traverses the action portion 78*b* of the cam slot with no forward movement of the feed finger occurring as the cam pin continues downwardly into the dwell portion 78*c* of the cam slot as the slide completes its downward movement. As the slide completes its downward movement, dies 24 coact in known manner to crimp the portions 10*d* of the terminal over the bare lead 59*a* and sever the terminal from the carrier band 10*a*, and strippers act in known manner to eject the lead and terminal combination from the dies.

As the slide begins to move upwardly on its return stroke, cam pin 50 initially moves upwardly in dwell portion 78*c* of the cam slot so that no movement of the feed finger occurs during this initial fraction of the upward movement of the slide whereafter, as the cam pin 50 moves onto the action portion 78*b* of the slot, finger 87 is biased downwardly against the urging of spring 89 out of engagement with the engaged drive hole 10*c* and dragged rearwardly or to the left as seen in FIG. 1 along the underface of the carrier band 10*a* toward a new drive hole 10*c*. As the cam pin completes its movement along the action portion 78*b* of the cam slot, the pointed end 87*b* of feed finger 87 arrives at a new drive hole 10*c* into which it is urged by the biasing of spring 89. Depending upon the stroke of the particular crimping apparatus with which the invention applicator die is used, the upward movement of the slide may cease at such time as cam pin 50 has completed its upward movement along the action portion 78*b* of the cam slot or, in the case of a machine having a relatively longer stroke, the cam pin may continue upwardly in dwell portion 78*a* of the cam slot but this further upward movement has no effect on the feed finger 89 which remains with its pointed drive front end in engagement with the drive hole 10*c* preparatory to the next downward driving movement of the slide to move the terminal strip incrementally forwardly and move another terminal 10*b* into position proximate the dies 24 for a further crimping action with respect to a new lead 59 and a further severing action with respect to the carrier band 10*a*.

The manner in which the leads 59 are fed into the coacting dies 24 does not form a part of the present invention. However, the present invention, by disposing the feed finger 87 beneath the terminal feed path, allows a total choice as between the available methods of feeding the leads to the machine and, in particular, allows the leads to be fed from the left as viewed in FIG. 1 above the guide plates 60,62 to the coacting dies if such a feed path is desired. Other possible lead feed paths include a path accessing dies 24 from the right as viewed in FIG. 1 or various other lead feed paths accessing the dies 24 from above, below, in front of, or behind the machine. As noted, the present invention allows total freedom of choice as between the various available lead feed paths so that the invention applicator die may be used with any crimping machine irrespective of the lead feed path employed by the crimping machine.

The present invention also allows the invention applicator die to be utilized with crimping machines or presses having varying stroke lengths with the variations in stroke lengths being accommodated by the dwell portion 78*a* at the top of cam slot 78. That is, for presses having a relatively short stroke, the cam pin 50 completes its upward movement at the upper end of the action portion 78*b* of the cam slot but for presses having longer strokes the cam pin continues upwardly into the dwell portion 78*a* for a distance sufficient to accommodate the additional stroke length.

The invention applicator die also provides steady and effective braking of the terminal band with the brake lever 102 arranged to at all times apply a uniform smooth braking action to the underside of carrier band 10*a* by virtue of the parallel disposition of the upper face 102*c* of lever 102 with respect to the underface of the carrier band to maximize the frictional engagement between the brake member and the carrier band and to provide a smooth, uniform braking action. The magnitude of the braking action may be readily adjusted by a simple adjustment of set screw 108 to vary the bias exerted by spring 106 and excessive upward braking force against the carrier band is prevented by engagement of the upper face of lever portion 102*a* with the lower face 60*c* of the lower guide plate 60. The invention brake assembly 32 also allows an absolutely identical brake assembly to be used for both the illustrated left side terminal strip feed path as well as for a right side terminal strip feed path. The invention applicator die also allows ready adjustment of the feeder mechanism to accommodate various presses, various crimping applications, and various terminal strips. Specifically, finger 87 may be moved longitudinally relative to the cam plate 70 by virtue of screws 84 operating in elongated slots 85, and finger 87 may be moved transversely or laterally relative to the cam plate by adjusting movement of screw 86 in slot 82*a*.

It will further be seen that although the invention applicator die has been illustrated as operating in a post-feed manner, that is operating to advance the terminal strip as the slide 22 moves downwardly, the invention applicator die may be readily adjusted to provide pre-feeding, that is feeding of the terminal strip as the slide 22 is moved upwardly.

The invention applicator die will be see to have universal application to all currently utilized crimping machines since it is compatible with any method of feeding the leads to the dies and is compatible with any of the various strokes currently employed by the currently utilized crimping machines.

The invention applicator die further includes a gathering mechanism 110 to ensure that the leads 59 are presented to the die means in such a manner as to ensure a positive crimping and cutting operation. Specifically, gathering mechanism 110 ensures that the leads. 59, irrespective of the manner in which the leads are fed to the applicator die, assume a predetermined orientation relative to the feed path of the terminal strip and assume a central position with respect to the applicator dies with the predetermined orientation normally constituting a perpendicular orientation relative to the feed path of the terminal strip.

Gathering mechanism 110 includes a pivot pin 112; a left gathering finger 114; a right gathering finger 116; a pair of dowel pins 118; a set screw 120; a spring 121; and a pair of cam surfaces 40*a*.

Pivot pin assembly 112 includes a pivot pin 122, a screw 124, and a washer 126.

Pivot pin 122 includes a rear pilot portion 122*a*, a journal portion 122*b*, a flange portion 122*c*, and a shoulder portion 122*d* having a tapped bore 122*e*.

Screw 124 is sized to be threaded into tapped bore 122*e* and washer 126 is sized to pass the screw 124 so that, with screw 124 threaded into tapped bore 122*e*, washer 126 is clamped against the end face of shoulder portion 122*d*.

Left finger 114 includes an upper end 114*a*, a lower end 114*b*, a central cutout 114*c*, a central bore 114*d* sized to journal on pivot pin journal portion 122*b*, and a bore 114*e* in upper portion 114*a*.

Right pin 116 includes an upper end 116*a*, a lower end 116*b*, a central cutout 116*c*, a central bore 116*d* sized to journal on pivot pin journal portion 122*b*, and a bore 116*e* in upper portion 116*a*.

It will be understood that fingers 114 and 116 are sized and configured so as to fit together in scissors fashion on pin journal portion 122*b* with cutouts 114*c* and 116*c* coacting to allow the fingers to pivot relative to each other while maintaining upper portions 114*a*, 116*a* in alignment and maintaining lower portions 114*b*, 116*b* in alignment.

Dowel pins 118 are sized to be press fit in bores 114*a*, 116*a* respectively with a portion 118*a* of each dowel projecting forwardly from the related finger and a portion 118*b* projecting rearwardly from the related finger.

Spring 121 is a coil spring and includes a main body coil portion 121*a* sized to fit over pin shoulder portion 122*d* between flange portion 122*c* and washer 126 and straight end portions 121*b* and 121*c*.

Cam surfaces 40*a* are defined along the respective inboard edges of gibs 40 and each include a lower dwell portion 40*b*, an upper dwell portion 40*c* and an intermediate action portion 40*d* interconnecting the upper and lower dwell portions.

In the assembled relation of the gathering mechanism 110 in the applicator die, the pilot portion 122*a* of pivot pin 122 is received in a bore 24*j* in cutter punch 24*b;* bores 114*e* and 116*e* of fingers 114 and 116 are journaled on pin journal portion 122*b;* pin flange portion 122*c* is positioned against the front face of fingers 114 and 116: spring 121 is positioned on pivot pin shoulder portion 122*d* with end portions 121*b* and 121*c* bearing respectively against the front portions 118*a* of the dowels 118 associated with the left and right fingers; and set screw 120 is threadably received in a threaded bore 24*k* in cutter punch 24*b* to engage pilot portion 122*a* of pivot pin 122 to preclude inadvertent removal of the gathering mechanism 110 from the applicator die and to allow ready removal of the gathering mechanism when desired by simply loosening screw 120.

The rear end portions 118*b* of dowel pins 118 will be seen to constitute cam pins which ride on cam surfaces 40*a* so that the fingers 114 and 116 move together and apart at their upper and lower ends in scissors fashion in response to vertical movement of slide 22 in slideway 42 with spring ends 121*b* and 121*c* bearing against dowel front end portions 118*a* to ensure that the dowel portions 118*b* maintain contact with the cam surfaces 40*a* at all points in the travel of the dowel portions 118*b* along the cam surfaces. It will be seen that, with the dowel portions 18*b* engaging the dwell portions 40*c* of the cam surfaces as seen in FIG. 1, corresponding to a relatively raised disposition of the slide 22, the upper and lower ends of the fingers are spaced apart, and that as the slide 22 moves downwardly in the slideway 42, the dowel portions 118*b* engage the action portions 40*d* of the cam surfaces to move the upper and lower ends of the fingers together until the dowel portions 118*b* reach the dwell portions 40*b* of the cam surfaces, whereafter further downward movement of the slide in the slideway maintains a constant spacing 130 between the inboard faces 114*f*, 116*f* of the lower finger 118*b*, 116*b* portions with the spacing 130 designed to approximate or slightly exceed the diameter of the main body or insulated portion 59*b* of a lead 59.

Cutouts 241 in the opposite side faces of cutter punch 24*b* provide clearance for the dowel portions 118*b* as the dowel pins move off of the action portions 40*d* of the cam surfaces and onto the dwell portions 40*b* and, specifically, dowel portions 118*b* move into the cutouts 241 as they enter upon the dwell portions 40*b* and nest within the cutouts 241 with continued downward movement of the gathering mechanism.

It will be seen that the fingers 114 and 116 operate to draw about and gather up a lead 59 and ensure that the lead is positioned in a precise positional orientation relative to the feed path of the terminal strip and relative to the dies so as to ensure a firm positive crimping and cutting action as the slide reaches its lower crimping position. Specifically, if the lead is positioned perpendicular to the terminal strip feed path and in alignment with the die means, the lower ends of the fingers 114, 116 will simply move into an embracing or surrounding relation to the insulated portion 59*b* of the lead and will not actually move the lead whereas if the lead is displaced either to the left or right with respect to the predetermined desired orientation the fingers will have the effect of moving the lead to the desired predetermined orientation so as to ensure a positive and successful crimping and cutting operation.

It will be understood that the invention gathering mechanism operates effectively to properly orient the leads irrespective of the manner in which the leads are fed to the crimping dies. Specifically, whether the leads are fed manually, semi-automatically, or fully automatically to the crimping die, the gathering mechanism 110 serves to positively and effectively ensure that the leads are positioned in the predetermined desired orientation relative to the feed path of the terminal strip and relative to the crimping dies. As noted, the gathering mechanism 110 may be readily attached to the front face of the cutter punch 22*b* simply by inserting pivot pin pilot portion 122*a* in cutter punch bore 24*j* and tightening the set screw 120, and may be readily removed from the front face of the cutter punch when the gathering function, is no longer required or desired by simply loosening the set screw.

Whenever the directions vertical, horizontal, above, or below are specified in the appended claims, it will be understood that these terms are limiting only in the sense of requiring a particular relative disposition as between the specified directions.

Whereas a preferred embodiment of the invention has been illustrated and described in detail, it will be apparent that various changes may be made in the disclosed embodiment without departing from the scope or spirit of the invention.

What is claimed is:

1. An applicator die for use with a crimping machine of the type in which a supply of terminals is fed to the machine in the form of a terminal strip comprising a plurality of serially arranged, interconnected terminals, individual leads are fed to the machine, and the machine functions to crimpingly apply a terminal to an end of each lead and sever the terminal from the terminal strip in a manner to provide a series of leads each having a terminal crimpingly secured to an end thereof, said applicator die including:

a housing defining a generally vertical slideway;

means defining a generally horizontal feed path for the terminal strip;

a slide mounted for reciprocal generally vertical sliding movement in said slideway;

die means operative in response to sliding movement of said slide in said slideway to crimp a terminal to a lead positioned proximate the die means and sever the terminal from the terminal strip; and gathering means including a pair of fingers pivotally mounted on said slide and coacting means on said fingers and on said housing operative in response to sliding movement of said slide in said slideway to move said fingers together to gather up a lead positioned proximate the die means and position the lead in a predetermined orientation relative to said feed path and relative to said die means if the lead is not already in that predetermined orientation.

2. An applicator die according to claim 1 wherein:

said predetermined orientation is perpendicular to said feed path and aligned with said die means.

3. An applicator die according to claim 1 wherein:

said fingers are mounted on said slide for relative pivotal movement in scissors fashion.

4. A applicator die according to claim 3 wherein:

said fingers are pivotally mounted intermediate their upper and lower ends about a common axis on said slide;

said coacting means comprise means on the upper ends of said fingers coacting with cam means carried by said housing proximate said slideway to move said finger upper ends toward and away from each other in response to movement of said slide; and the lower ends of said fingers are moved into gathering relation to opposite sides of the lead as the slide moves downwardly in the slideway.

5. An applicator die for use with a crimping machine of the type in which a supply of terminals is fed to the machine in the form of a terminal strip comprising a plurality of serially arranged interconnected terminals, individual leads are fed to the machine, and the machine functions to crimpingly apply a terminal to an end of each lead and sever the terminal from the terminal strip in a manner to produce a series of leads each having a terminal crimpingly secured to an end thereof, the die including a housing defining a generally vertical slideway, means defining a generally horizontal feed path for the terminal strip, a slide mounted for reciprocal generally vertical sliding movement in the slideway, die means operative in response to sliding movement of the slide in said slideway to crimp a terminal to a lead and sever the terminal from the terminal strip, gathering means driven by the slide and operative in response to sliding movement of the slide in the slideway to draw about a lead positioned proximate the die means and move the lead to a predetermined orientation relative to said feed path and relative to said die means if the lead is not already in that predetermined orientation; characterized in that the gathering means comprises a pair of fingers pivotally mounted on the slide for sliding movement with the slide and drive means are provided to move the lower ends of the fingers together in response to downward movement of the slide to draw the fingers about the lead.

6. An applicator means according to claim 5 wherein:

said predetermined orientation is perpendicular to said feed path and aligned with said die means.

7. An applicator die according to claim 5 wherein said fingers are pivotally mounted intermediate their upper and lower ends about a common axis on said slide; and said drive means comprises coacting means on the upper ends of said fingers coacting with cam means carried by said housing proximate said slideway to move said finger upper ends toward and away from each other in response to movement of said slide.

8. An applicator die according to claim 7 wherein:

said cam means comprises a pair of cam surfaces defined at opposite sides of said slideway; and said coacting means on the upper ends of said fingers comprises a cam pin carried by each finger at the upper end thereof and respectively coacting with said cam surfaces.

9. An applicator die according to claim 7 wherein:

said gathering means further includes spring means urging said fingers in an outward, opening direction.

10. An applicator die according to claim 9 wherein:

said gathering means further includes spring means urging said fingers in an outward direction to urge said cam pins against the respective cam surfaces.

11. An applicator die according to claim 10 wherein:

said fingers are mounted for pivotal movement on a pivot pin; and said spring means includes a coil spring mounted on said pivot pin and having opposite ends respectively engaging said cam pins.

12. A gathering mechanism for use with an applicator die of the type including a housing defining a generally vertical slideway, means defining a generally horizontal feed path for a terminal strip comprising a plurality of serially arranged inter-connected terminals, a slide mounted for reciprocal generally vertical sliding movement in the slideway, and die means operative in response to sliding movement of the slide to crimp a terminal strip to a lead positioned proximate the die means and sever the terminal from the terminal strip, said gathering means including:

a gathering device having open and closed positions;

means for attaching said device to said slide for translatory movement with said slide; and means operative in response to the translatory movement of said device with said slide to move said device between its open and closed positions.

13. A gathering mechanism according to claim 12 wherein:

said operative means includes cam means at the upper ends of said fingers coacting with cam surfaces defined on the housing of the applicator die proximate the slideway.

14. A gathering mechanism according to claim 12 wherein:

said gathering device includes a pair of fingers arranged in scissors fashion.

15. A gathering mechanism according to claim 16 wherein:

said attaching means comprises a pivot pin journaling said fingers and including a portion adapted to be received in said slide.

16. A gathering mechanism according to claim 14 wherein:

said gathering mechanism further includes a spring biasing said fingers toward their open positions.

17. A gathering mechanism according to claim 16 wherein:

said attaching means comprises a pivot pin journaling said fingers and including a rear portion adapted to be received in the front face of said slide to mount said device on the front face of said slide.

18. A gathering mechanism according to claim 17 wherein:

said spring includes a main body coil portion; and said pivot pin includes a further portion mounting said spring main body coil portion.

19. A gathering mechanism according to claim 18 wherein:

said operative means includes cam means at the upper ends of said fingers coacting with cam surfaces defined on the housing of the applicator die proximate the slideway.

20. A gathering mechanism according to claim 19 wherein:

said cam means comprise a pin carried by the upper end of each finger and engaging the cam surfaces on the housing.

21. A gathering mechanism according to claim 20 wherein:

said spring further includes end portions respectively urged against said pins to urge said fingers toward their open position.

22. A gathering mechanism according to claim 21 wherein:

said pins each include a rearward portion extending rearward from the respective finger and a forward portion extending forwardly from the respective finger;

said rearward portions engage the cam surfaces on the applicator die housing; and said forward portions are engaged by said end portions of said spring.

23. A gathering mechanism according to claim 12 wherein the slide includes a pocket opening in the front face of the slide adapted to receive a die member therein; and said attaching means is adapted to attach said gathering device to the front face of the die member received in the pocket in the slide.

24. A gathering mechanism according to claim 23 wherein:

said attaching means includes a pin having a rear portion received in a bore in the die member and a journal portion forwardly of the rear portion; and said gathering device includes a pair of fingers pivotally mounted on said pin journal portion.

25. A gathering mechanism according to claim 24 wherein:

said gathering mechanism further includes a coil spring mounted on a portion of said pin forwardly of said journal portion.

26. An applicator die for use with a crimping machine of the type in which a supply of terminals is fed to the machine in the form of a terminal strip comprising a plurality of serially arranged, interconnected terminals, individual leads are fed to the machine, and the machine functions to crimpingly apply a terminal to an end of each lead and sever the terminal from the terminal strip in a manner to produce a series of leads each having a terminal crimpingly secured to an end thereof, said applicator die including:

a housing defining a generally vertical slideway;

means defining a generally horizontal feed path for the terminal strip;

a slide mounted for reciprocal generally vertical sliding movement in said slideway;

die means operative in response to sliding movement of said slide in said slideway to crimp a terminal to a lead and sever the terminal from the terminal strip;

feed means operative to incrementally advance the terminal strip along said feed path toward said die means; and a brake assembly positioned beneath said feed path and including a brake element spring biased upwardly to bring a braking surface on said brake element into frictional engagement with the undersurface of the terminal strip, said brake element comprising a lever mounted for pivotal movement about an axis generally parallel to said feed path, said braking surface being defined on said lever proximate one end thereof, and the braking surface being moved in response to spring biased upward movement of the lever into a horizontal braking disposition in which the braking surface is parallel to the plane of the terminal feed path and immediately underlying the undersurface of the terminal strip.

* * * * *